US005981858A

United States Patent [19]

Jeng

[11] Patent Number: 5,981,858

[45] Date of Patent: Nov. 9, 1999

[54] BAMBOO DRUM

[76] Inventor: Jun-Chan Jeng, Chang Shang Road, Taichung Hsien, Taiwan

[21] Appl. No.: 09/097,462

[22] Filed: Jun. 15, 1998

[51] Int. Cl.[6] ..... G10D 13/00; G10D 13/02

[52] U.S. Cl. ..... 84/411 R; 84/104; 84/412

[58] Field of Search ..... 84/104, 411 R, 84/412–417

[56] References Cited

U.S. PATENT DOCUMENTS 1,429,843 9/1922 Christian ..... 84/411 R

*Primary Examiner*—Robert E. Nappi
*Assistant Examiner*—Marlon T. Fletcher
*Attorney, Agent, or Firm*—Harrison & Egbert

[57] ABSTRACT

A bamboo drum has a hollow cylinder formed of a plurality of ring bodies stacked together. The ring bodies are made of bamboo sheets and provided respectively along the upper ring portion thereof with a protruded circular rib, a circular groove, and an inclined circular surface for enabling the ring bodies to be stacked together to form the hollow cylinder without voids. Each of the ring bodies has two end portions of various forms to provide the two end portions with the contact areas capable of fusing securely the two end portions of the ring body.

7 Claims, 6 Drawing Sheets

BAMBOO DRUM

FIELD OF THE INVENTION

The present invention relates generally to a musical instrument, and more particularly to a drum made of bamboo stems.

BACKGROUND OF THE INVENTION

As shown in FIG. 1, a wooden drum 10 of the prior art is made of a plurality of layers of thin wooden sheets 11. The thin wooden sheets 11 are generally made of the discarded wood. There are often voids that are present between layers of the wooden sheets 11. It is technically difficult to avoid the formation of voids when the wooden drum 10 is made. The poor quality of the thin wooden sheets 11 and the voids can prevent the drum 10 from producing good quality sound.

SUMMARY OF THE INVENTION

The primary objective of the present invention is therefore to provide a drum made of bamboo stems and capable of producing excellent quality sound.

In keeping with the principle of the present invention, the foregoing objective of the present invention is attained by a bamboo drum of a hollow cylinder with a membrane stretched tightly over one or both ends thereof. The cylinder of the bamboo drum is formed of a plurality of ring bodies superimposed upon one another. The ring bodies are made of the bamboo fibers which are longitudinally oriented. Each ring body is provided along the upper ring portion thereof with a protruded circular rib, a circular groove, and an inclined circular surface located between the protruded circular rib and the circular groove. The ring bodies are thus stacked together securely without the void. Each ring body has two end portions which are slanted horizontally or longitudinally such that the contact areas between the two end portions are greatly enlarged to ensure the secure fusion of the two end portions of the ring body.

The foregoing objective, features, functions, and advantages of the present invention will be more readily understood upon a thoughtful deliberation of the following detailed description of the present invention with reference to the accompanying drawings.

DETAILED DESCRIPTION OF THE INVENTION

Figure 1:
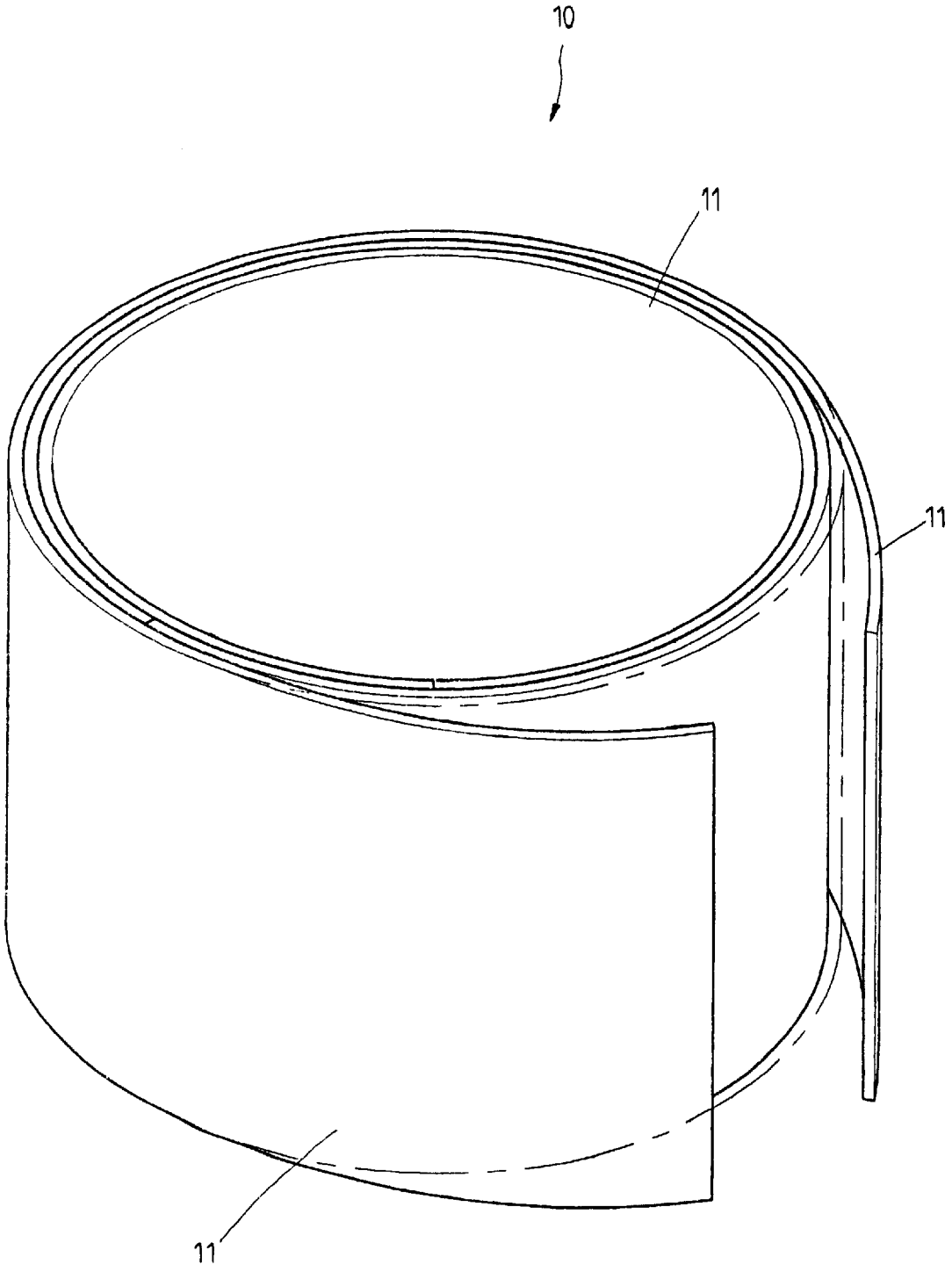
FIG.1 PRIOR ART
FIG. 1 shows a schematic view of the construction of a wooden drum of the prior art.
Figure 2:
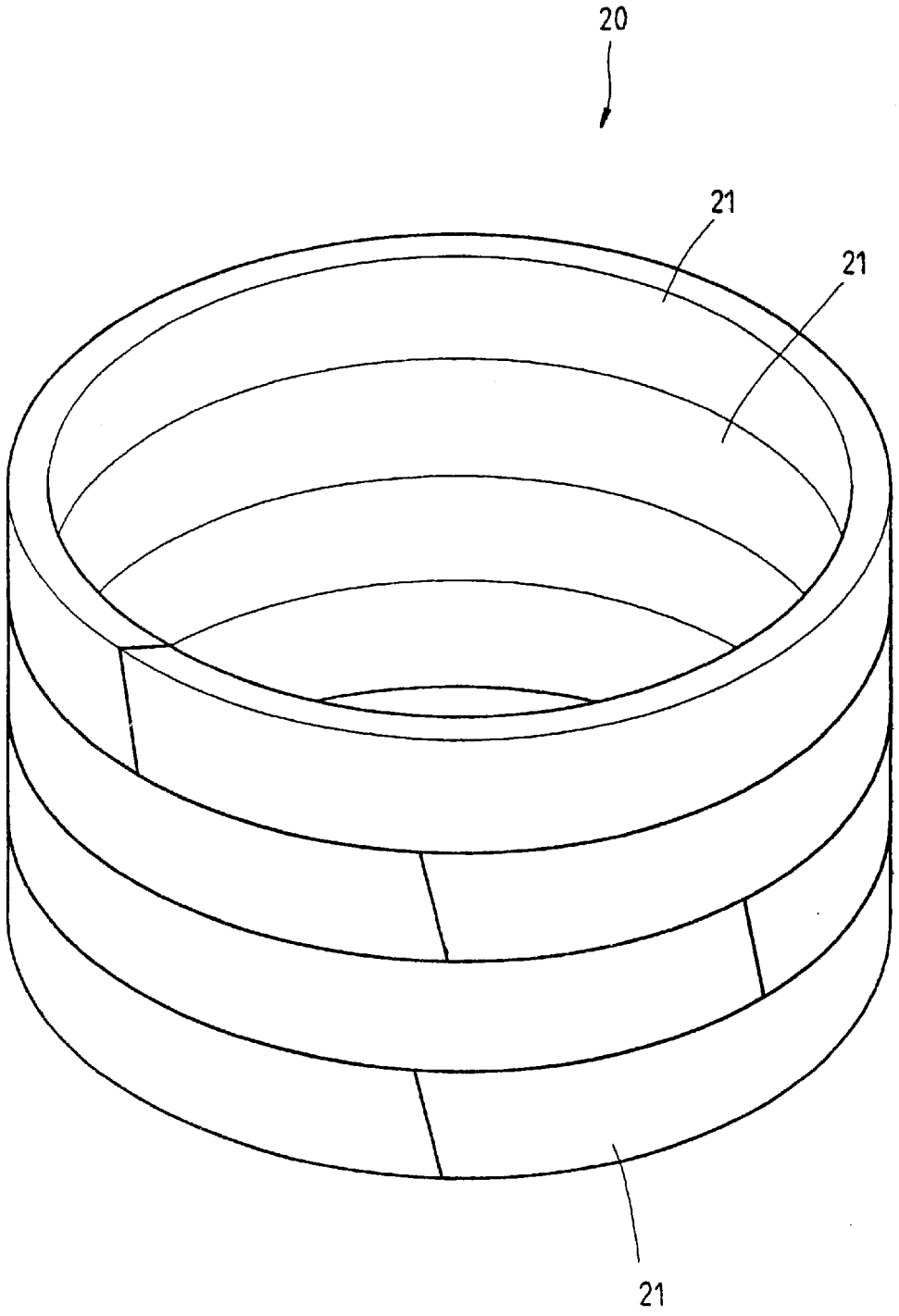
FIG. 2 shows a perspective view of a bamboo drum of the present invention.
Figure 3:
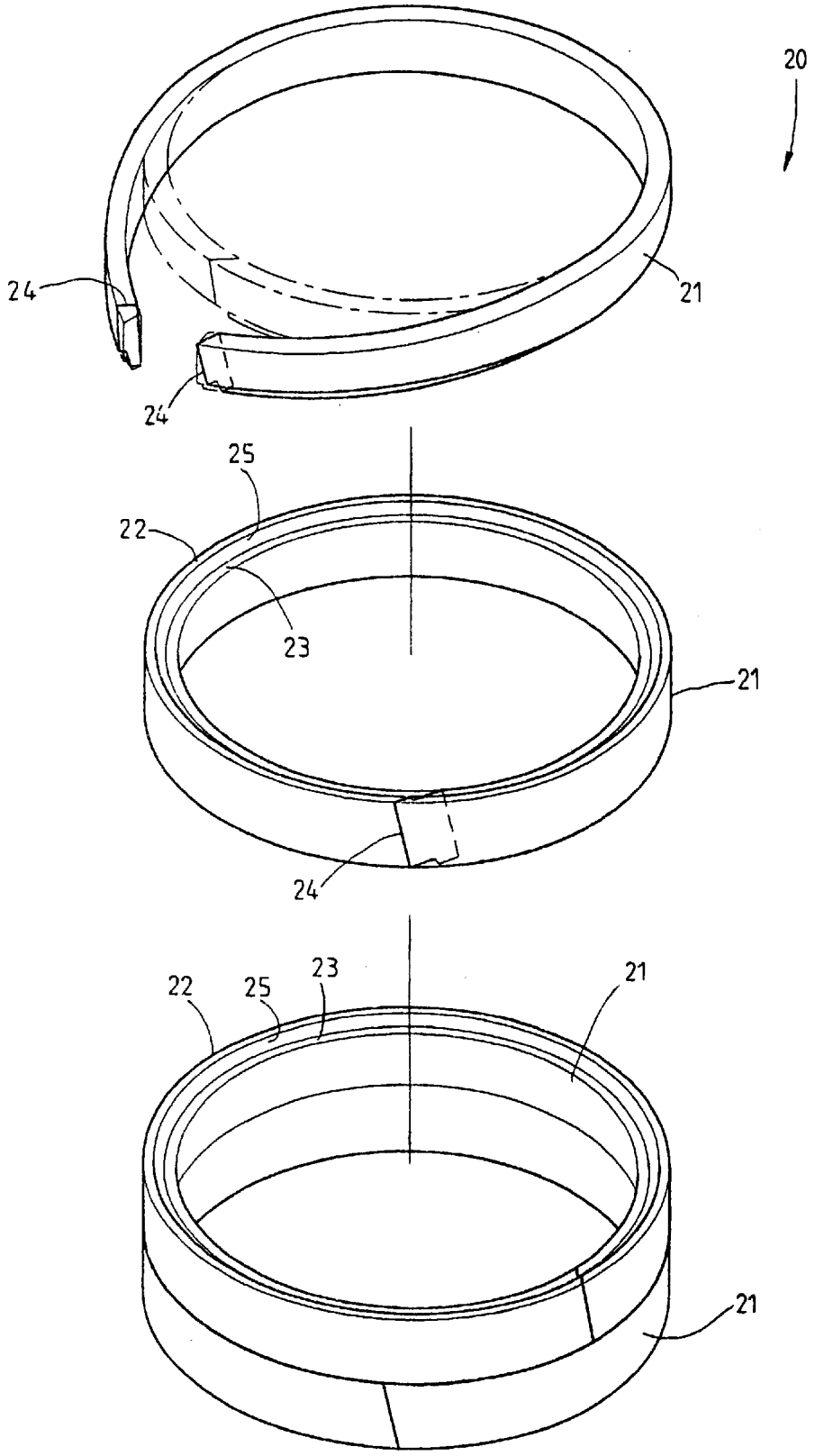
FIG. 3 shows an exploded view of the bamboo drum of the present invention.
Figure 4:
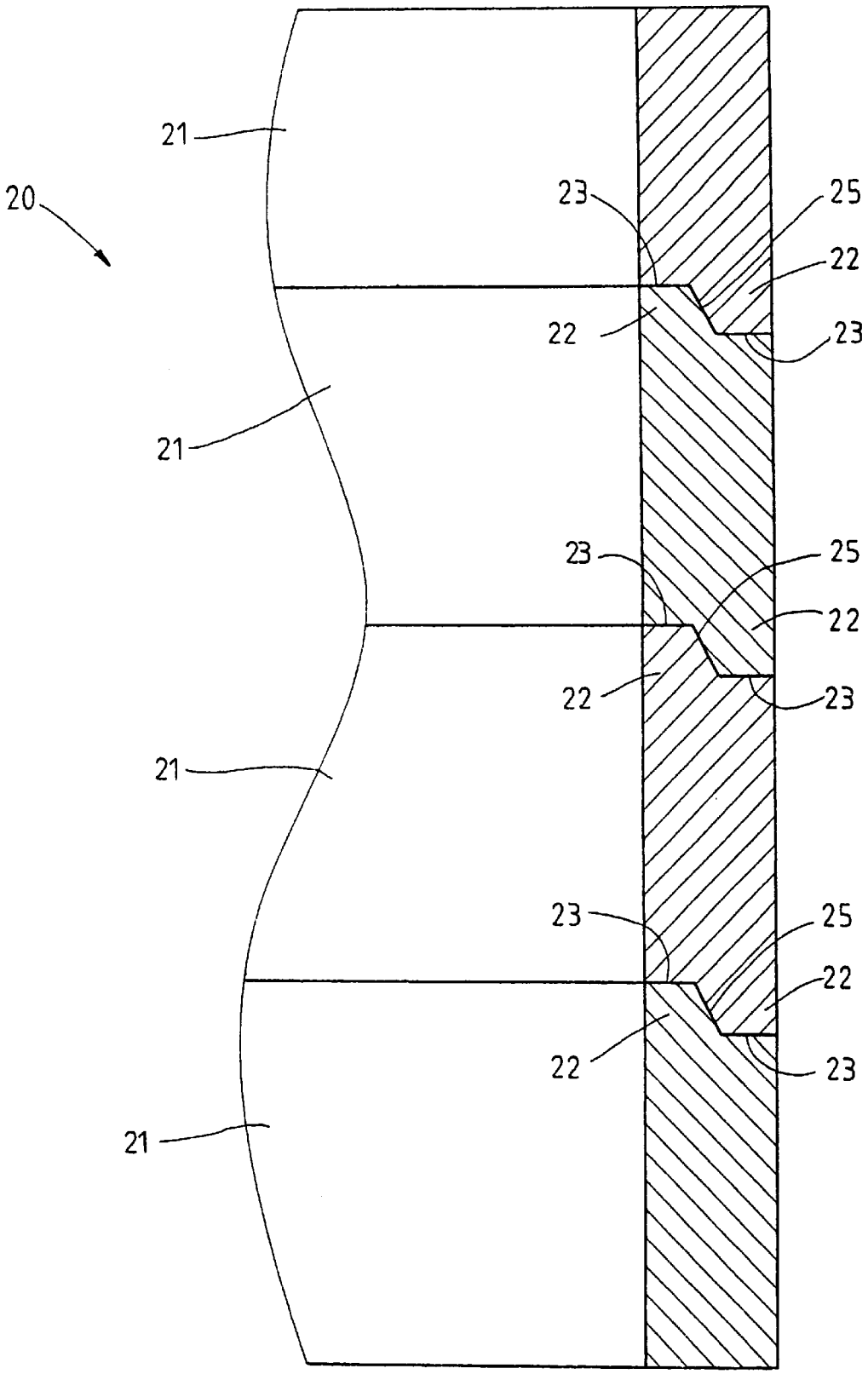
FIG. 4 shows a longitudinal sectional view of the bamboo drum of the present invention in combination.

As shown in FIGS. 2–8, a drum 20 embodied in the present invention has a hollow cylinder with a membrane (not shown in the drawings) stretched tightly over one or both ends thereof. The cylinder of the drum 20 is formed of a plurality of ring bodies 21, which are stacked together. Each of the ring bodies 21 is made of the bamboo sheet having bamboo fibers which are longitudinally oriented. Each ring body 21 is provided along the upper ring portion thereof with a protruded circular rib 22, a circular groove 23, and an inclined circular surface 25 located between the protruded circular rib 22 and the circular groove 23. The ring bodies 21 are thus stacked together to form the hollow cylinder of the drum 20 without the voids, as shown in FIG. 4. It must be noted here that the inclined circular surface 25 may be modified in such a manner that the inclined surface is changed to an upright circular surface for reinforcing the structural strength of the base portion of the protruded circular rib 22 of the ring body 21.

Figure 5:
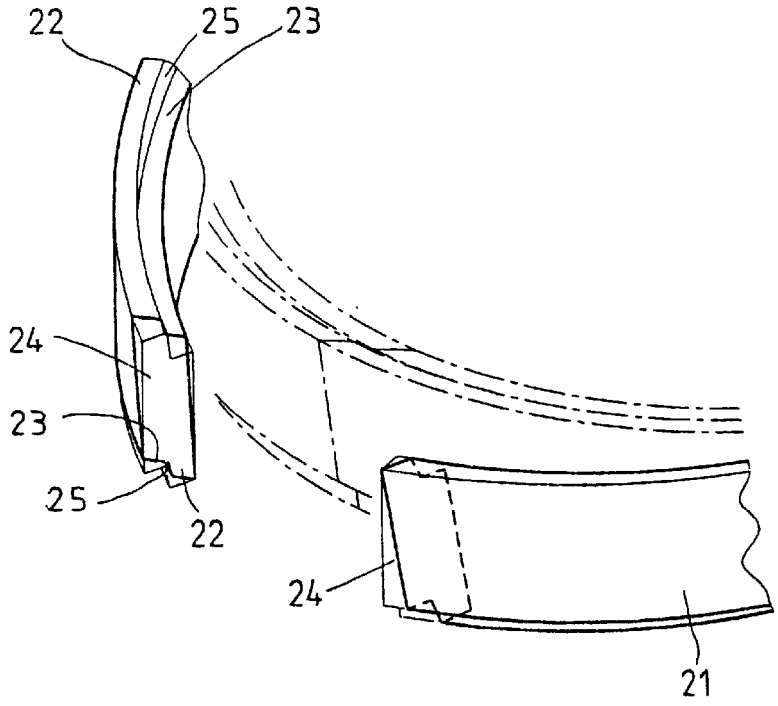
FIG. 5 shows a schematic view of two end portions of a ring body of the bamboo drum of the present invention.
Figure 6:
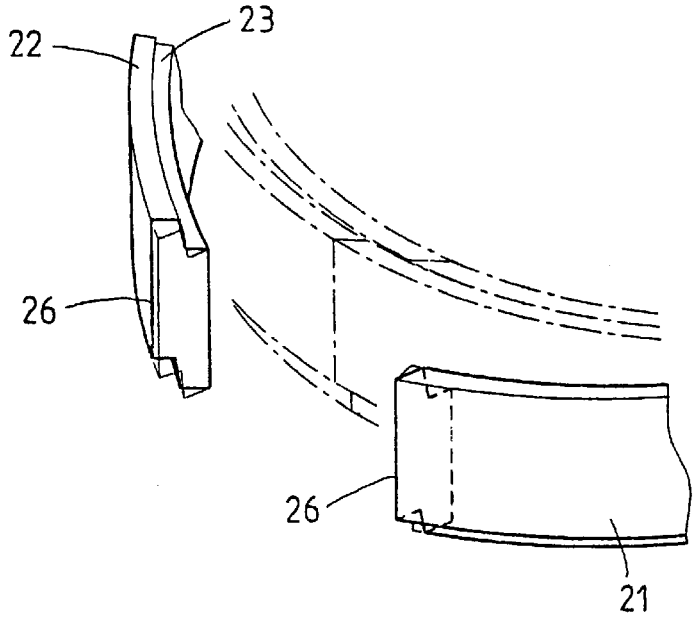
FIG. 6 shows another schematic view of two end portions of a ring body of the bamboo drum of the present invention.
Figure 7:
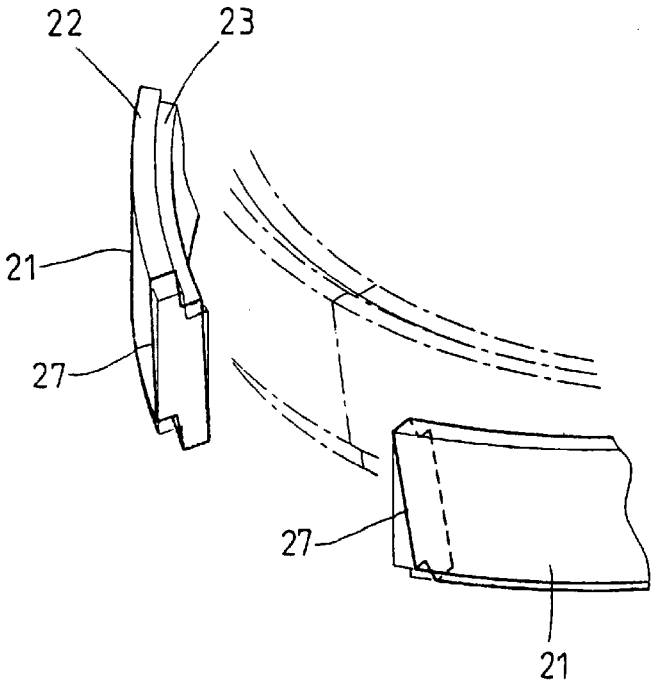
FIG. 7 shows still another schematic view of two end portions of a ring body of the bamboo drum of the present invention.

Each ring body 21 has two end portions, each of which may be constructed as a three-dimensional bevel led end portion 24, as shown in FIG.5, or a radially tilted end portion 26, as shown in FIG. 6, or a longitudinally tilted end portion 27, as shown in FIG. 7. In other words, the end portions of the ring body 21 may take various forms so as to increase the contact areas of the two end portions of the ring body 21, thereby resulting in a secure fusion of the two end portions of the ring body 21.

Figure 8:
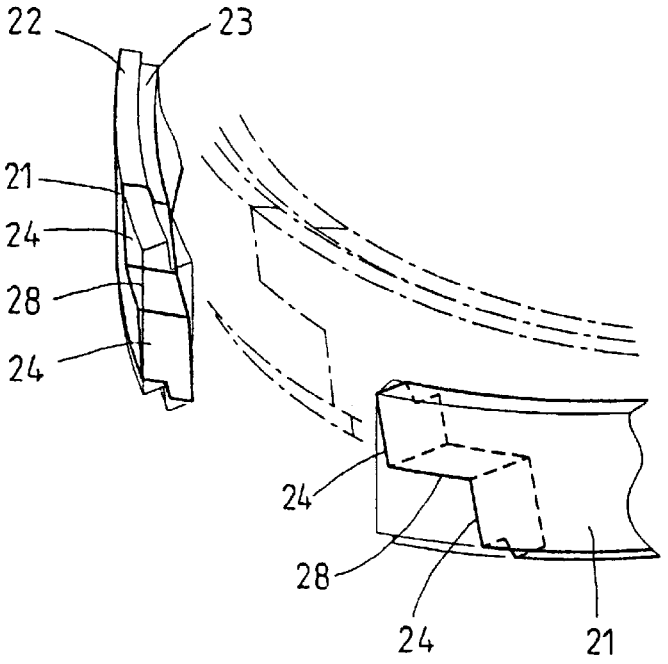
FIG. 8 shows still another schematic view of two end portions of a ring body of the bamboo drum of the present invention.

As illustrated in FIG. 8, the two end portions of the ring body 21 may be further provided with a coupling surface 28 to reinforce the fusion of the two end portions of the ring body 21.

The bamboo drum 20 of the present invention is thus capable of producing sound of excellent tone and volume.

I claim:

1. A bamboo drum comprising a hollow cylinder formed of a plurality of ring bodies made of a bamboo sheet, said ring bodies provided respectively along an upper ring portion thereof with a protruded circular rib, a circular groove, and an inclined circular surface located between said protruded circular rib and said circular groove, each of said ring bodies having two end portions capable of fusing together.

2. The bamboo drum as defined in claim 1, wherein said bamboo sheet has bamboo fibers which are longitudinally oriented.

3. The bamboo drum as defined in claim 1, wherein said circular surface located between said protruded circular rib and said circular groove is perpendicular relative to said protruded circular rib.

4. The bamboo drum as defined in claim 1, wherein said two end portions of said each of said ring bodies are provided with a three-dimensional bevel led end portion.

5. The bamboo drum as defined in claim 1, wherein said two end portions of said each of said ring bodies are provided with a radially tilted end portion.

6. The bamboo drum as defined in claim 1, wherein said two end portions of said each of said ring bodies are provided with a longitudinally tilted end portion.

7. The bamboo drum as defined in claim 1, wherein said two end portions of said each of said ring bodies are provided with a coupling surface.

* * * * *